United States Patent [19]

Abe et al.

[11] Patent Number: 4,822,725

[45] Date of Patent: Apr. 18, 1989

[54] METHOD FOR BLEACHING COLOR PHOTOGRAPHIC MATERIAL

[75] Inventors: Akira Abe; Shinzo Kishimoto; Yasuhisa Ogawa, all of Kanagawa, Japan

[73] Assignee: Fuji Photo Film Co., Ltd., Kanagawa, Japan

[21] Appl. No.: 248,288

[22] Filed: Sep. 22, 1988

Related U.S. Application Data

[63] Continuation of Ser. No. 89,052, Aug. 24, 1987, abandoned, which is a continuation of Ser. No. 736,627, May 21, 1985, abandoned.

[30] Foreign Application Priority Data

May 21, 1984 [JP] Japan ..... 59-102355

[51] Int. Cl.[4] ..... G03C 5/44

[52] U.S. Cl. ..... 430/393; 430/430; 430/461

[58] Field of Search ..... 430/430, 461, 393

[56] References Cited

U.S. PATENT DOCUMENTS

| | | | |
|---|---|---|---|
| 3,772,020 | 11/1973 | Smith | 430/393 |
| 3,893,858 | 7/1975 | Wabnitz | 430/393 |
| 4,268,618 | 5/1981 | Hashimura | 430/430 |
| 4,293,636 | 10/1981 | Itoh et al. | 430/430 |
| 4,293,639 | 10/1981 | Itoh et al. | 430/430 |
| 4,458,010 | 7/1984 | Yamamuro et al. | 430/393 |
| 4,506,007 | 3/1985 | Nakajima et al. | 430/393 |
| 4,546,070 | 10/1985 | Kishimoto et al. | 430/393 |

*Primary Examiner*—Richard L. Schilling
*Attorney, Agent, or Firm*—Sughrue, Mion, Zinn, Macpeak, and Seas

[57] ABSTRACT

A method for processing a silver halide color photographic material is described which comprises subjecting an imagewise exposed silver halide color photographic material to color development and then bleaching the developed color photographic material with a bleaching solution containing a ferric salt of an aminopolycarboxylic acid, wherein the bleaching solution additionally contains at least one compound represented by the following general formula (I) or (II)

(I)

(II)

wherein $R_1$ and $R_2$ are identical or different and each represents a hydrogen atom or a methyl or ethyl group, and n represents an integer of 1 to 3, and wherein the oxidation reduction potential of the bleaching solution is adjusted to not more than 100 mV.

14 Claims, 1 Drawing Sheet

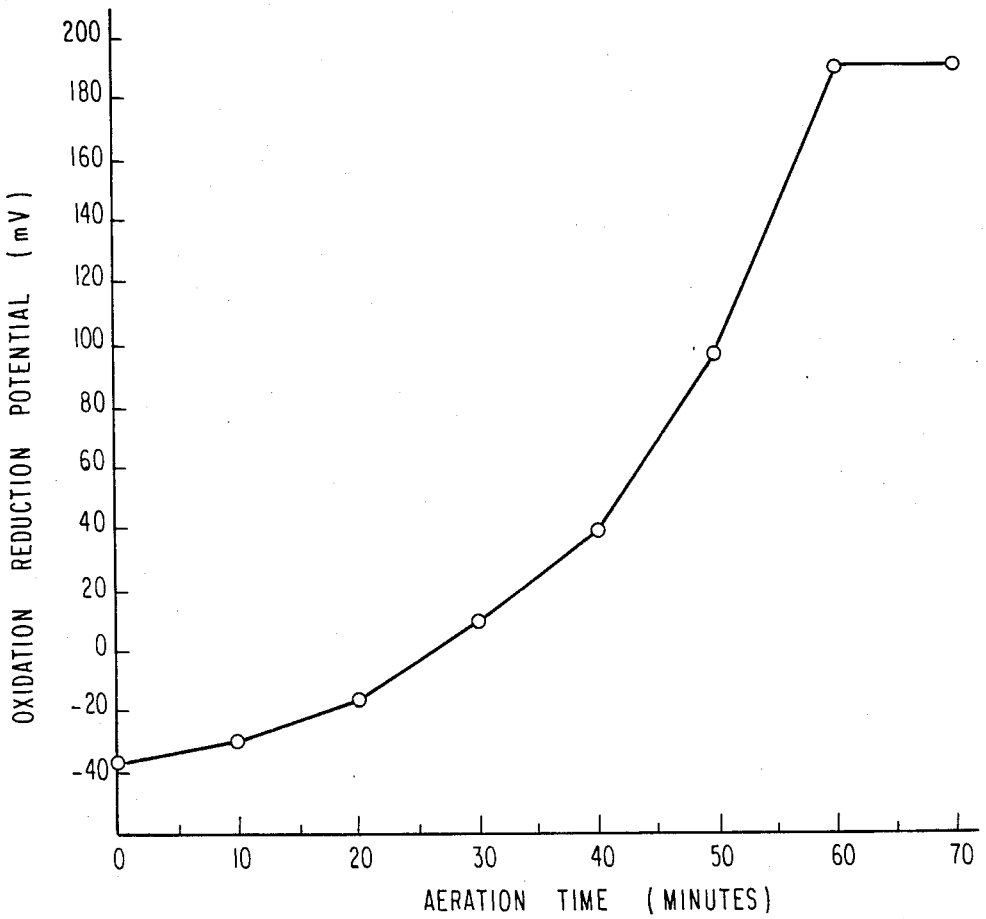
OXIDATION REDUCTION POTENTIAL (mV)
200
180
160
140
120
100
80
60
40
20
0
-20
-40
0
10
20
30
40
50
60
70
AERATION TIME (MINUTES)

METHOD FOR BLEACHING COLOR PHOTOGRAPHIC MATERIAL

This is a continuation of application Ser. No. 07/89,052 filed Aug. 24, 1987, now abandoned which is a File Wrapper Cont. of application Ser. No. 06/736,627 filed May 21, 1985, now abandoned.

FIELD OF THE INVENTION

This invention relates to a method for processing an imagewise exposed silver halide color photographic material (to be referred to as color photographic material) by development, bleaching and fixation. More specifically, it relates to an improved method of processing an imagewise exposed color photographic material wherein the bleaching reaction is promoted by using a specific bleach accelerator to shorten the processing time and perform the bleaching sufficiently, and, wherein the effect of the bleach accelerator can be retained for a long period of processing time.

BACKGROUND OF THE INVENTION

Generally, the basic steps of processing a color photographic material are a color development step and a desilvering step. In the color development step, the silver halide imagewise exposed is reduced to silver by a color developing agent, and the oxidized color developing agent reacts with a coupler to give a dye image. In the subsequent desilvering step, silver formed in the color development step is oxidized by the action of an oxidizing agent (usually called a bleaching agent), and thereafter dissolved by a complexing agent for silver ions generally called a fixing agent. By going through this desilvering step, only the dye image is formed in the color photographic material.

The desilvering step is carried out by using two baths, i.e., a bleaching bath containing an oxidizing agent and a fixing bath containing a silver ion complexing agent, or a monobath called a bleach-fix bath (blix bath). The present invention is applicable to a two-bath system comprising the bleaching bath and fixing bath.

The actual development process includes, in addition to the basic steps, various auxiliary steps for maintaining the photographic and physical quality of the image, improving the stability of the image, etc. Such additional steps are carried out by using a hardening bath, a stop bath, an image stabilizing bath, a water washing bath, etc.

Ferricyanides, bichromates, ferric chloride, ferric salts of aminopolycarboxylic acids, persulfates, etc. are generally known as the bleaching agent.

The ferricyanides and bichromates, however, give rise to a pollution problem because of the cyanides and hexavalent chromium, and special processing equipment is required for their use. Ferric chloride may form iron hydroxide or stains in the subsequent water washing step, and causes various troubles in practice. The persulfates have the disadvantage that because of their very weak bleaching ability, a very long period of time is required for bleaching. A method has been proposed in this regard to increase their bleaching action by using bleach accelerators. However, the persulfates themselves are designated as a dangerous material under the Fire Prevention Law, and various measures are required for their storage. Generally, therefore, it is difficult to use the persulfates in actual practice.

Ferric salts of aminopolycarboxylic acids (particularly, ferric salt of ethylenediaminetetraacetic acid) have little likelihood of causing pollution, and give rise to no storage problem unlike the persulfates. Thus, they are by far the most widely used bleaching agents at present. However, the bleaching power of the ferric salts of aminopolycarboxylic acids is by no means sufficient. The use of these ferric salts of aminopolycarboxylic acids as bleaching agents can achieve the desired purpose in bleaching or bleach-fixing processing of low-speed silver halide color photographic materials composed mainly of silver chlorobromide emulsions. They have the disadvantage of causing incomplete desilveration or requiring long periods of time for bleaching when they are used for processing high-speed color photographic material which contain silver chlorobromoiodide or silver iodobromide emulsion as a main component and are spectrally sensitized, particularly color reversal photographic materials or color negative photographic materials for photographing, each containing silver halide emulsion having a high silver content.

It has been strongly desired to increase the bleaching power of bleaching baths containing the ferric salts of aminopolycarboxylic acids and to achieve bleaching sufficiently and within short period of time even on color photographic materials of high-speed and a high silver content. To increase their bleaching power, it has been proposed to add various bleach accelerators to the bleaching bath.

Examples of the bleach accelerators proposed include the various mercapto compounds described in U.S. Pat. No. 3,893,858, British Pat. No. 138,842, and Japanese Patent Application (OPI) No. 14623/78, the compounds containing a disulfide bond described in U.S. Pat. No. 4,169,733 (corresponding to Japanese Patent Application (OPI) No. 95630/78), the thiazolidine derivatives described in Japanese Patent Publication No. 9854/78, the isothiourea derivatives described in U.S. Pat. No. 4,144,068 (corresponding to Japanese Patent Application (OPI) No. 94927/78), the thiourea derivatives described in U.S. Pat. Nos. 3,617,283 and 3,809,563 (corresponding to Japanese Patent Publication Nos. 8506/70 and 26586/74, respectively), the thioamide compounds described in British Pat. No. 1,394,357 (corresponding to Japanese Patent Application (OPI) No. 42349/74, and the dithiocarbamates described in Japanese Patent Application No. 26506/80.

Of the above bleach accelerators, the thiourea derivatives, thioamide compounds and dithiocarbamates do not have a sufficient bleach accelerating effect and cannot achieve the purpose of expediting the bleaching step.

The isothiourea derivatives, in many cases, require the copresence of sulfites in order to exhibit their effect sufficiently, and have the disadvantage of not producing an entirely satisfactory effect when added directly to bleaching baths comprising the ferric salts of aminopolycarboxylic acids.

Some of the thiazolidine derivatives have a substantially sufficient bleach accelerating effect, but are difficult to use in practical applications because of their high cost.

The compounds having a mercapto group or a disulfide bond, particularly aminoalkylene thiols and their disulfides, have a substantially sufficient bleach accelerating effect as do the thiazolidine derivatives, and are advantageous in practical applications because of their lower cost than the thiazolidine derivatives.

The present inventors studied the bleach accelerating effects of the aminoalkylene thiols and their disulfides from various practical viewpoints, and found that the following serious disadvantage. Specifically, the present inventors examined the effect of the aforesaid bleach accelerators added to a bleaching solution of the ferric salt of an aminopolycarboxylic acid while a color photographic material was continuously processed by an automatic processor. They have found that they showed a superior bleach accelerating effect in the early stage of the continuous processing (i.e., running), but with the progress of the processing, their effect decreased and was finally lost. This decrease in effect occurred in spite of the fact that the bleach accelerator was also added to a replenisher for bleaching solution, and the replenisher for bleaching solution was added in amounts usually considered suitable. This demonstrates the infeasibility of the above bleach accelerators.

SUMMARY OF THE INVENTION

It is a first object of this invention to provide a rapid processing method which can give a color photographic image of good quality at a high bleaching speed.

A second object of this invention is to provide a method of color photographic processing which can be easily put into practice with little problems of pollution without a problem in storage.

A third object of this invention is to provide a method in which the bleaching power of a bleaching solution comprising a ferric salt of an aminopolycarboxylic acid is improved by an inexpensive bleach accelerator and its effect is retained for long period of processing time.

The present inventors have achieved the foregoing objects by including at least one compound of general formula (I) or (II) below to a bleaching solution comprising a ferric acid of an aminopolycarboxylic acid, and adjusting the oxidation reduction potential of the bleaching solution, measured by a customary method using a platinum electrode and a silver chloride electrode, to not more than 100 mV.

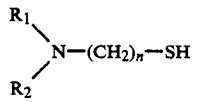

(I)

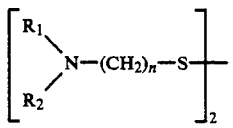

(II)

In general formula (I) or (II), $R_1$ and $R_2$ are identical or different and each represents a hydrogen atom or a methyl or ethyl group, and n represents an integer of 1 to 3.

BRIEF DESCRIPTION OF THE FIGURE

The FIGURE shows changes over the course of time of the oxidation reduction potential of a bleaching solution containing a ferric salt of ethylenediaminetetraacetic acid. The ordinate repreksents the oxidation reduction potential (mV) and the abscissa represents the aeration time (minutes).

DETAILED DESCRIPTION OF THE INVENTION

In general formula (I) or (II), each of $R_1$ and $R_2$ is preferably a methyl or ethyl group , and n is preferably 2.

In the present invention, the oxidation reduction potential of the bleaching solution denotes one measured by a combination of a platinum electrode and a silver chloride electrode at 25° C. If the oxidation reduction potential is 100 mV or less, the objects of this invention can be achieved. It is preferably −20 mV to 100 mV, more preferably 0 mV to 100 mV, especially preferably 20 mV to 80 mV.

In the method of this invention, the adjustment of the oxidation reduction potential of the bleaching solution to 100 mV or less is carried out at least after the initiation of bleaching. If desired, however, it may be carried out at the start of bleaching or in the early stage of processing.

The term "after the initiation of bleaching" means after the time when the effect of the added bleach accelerator begins to decrease. Usually, it is after several hours to 2 days.

The oxidation reduction potential of the bleaching agent can be adjusted, for example, by oxidizing the bleaching solution, increasing or decreasing the amount of aeration in the bleaching solution, circulating the bleaching agent within the bath without aeration, or mixing in a color developing agent, hydroxylamine, a sulfite, etc.

Aeration of the bleaching solution has already been known. For example, "Using Process C-41 (1982, Z-121, Third Edition)", page No. BL-2 or "Monitoring the performance of the process C-41 bleach (1982, Z-121D)" published by Eastman Kodak Company states in detail that to put the bleaching solution in a completely oxidized state by sufficient aeration is very important for preventing incomplete desilveration and the formation of a leuco cyan dye.

Since the ferric salt of aminopolycarboxylic acid used in the bleaching solution oxidizes the developed silver in the processing and receives the color develoer carried over from the previous step to thereby change to a ferrous salt of an aminopolycrboxylic acid, it has been considered that complete oxidation of the ferrous salt of aminopolycarboxylic acid to the ferric salt of aminopolycarboxylic acid by sufficient aeration is adequate for complete bleaching.

It can be seen from the general knowledge of electrochemistry that the oxidized state of the bleaching solution of a ferric salt of an aminopolycarboxylic acid can be shown by the oxidation reduction potential based on the quantitative ratio between ferrous ions and ferric ions. In fact, U.S. Pat. No. 3,773,510 discloses that increasing the oxidation reduction potential in a bleach-fix solution of ferric salt of ethylenediaminetetraacetic acid prevents the formation of a leuco cyan dye.

When the present inventors sampled 20 liters of a bleaching solution containing ferric salt of ethylenediaminetetraacetic acid which had been used in processing without aeration, and aerated it with 5 liters/min. of air, they obtained the results plotted in the FIGURE with regard to the aeration time and the oxidation reduction potential. The results of the FIGURE show that the oxidation reduction potential of the bleaching solution increases by aeration, and reaches about 190 mV when it is in a completely oxidized state.

The present inventors have also ascertained that a bleaching agent containing a ferric salt of an aminopolycarboxylic acid shows an oxidation reduction potential of at least 100 mW when used in processing in an automatic processor while performing the proper aeration described in the above-cited "Using Process C-41" published by Eastman Kodak Company.

In fact, the oxidation reduction potentials of bleaching solutions of ferric salts of aminopolycarboxylic acids used in development on the market are in many cases 120 mV to 190 mV.

The present inventors, however, have found that when the bleach accelerator of general formula (I) or (II) was included in the bleaching solution, and the bleaching bath was used in processing with sufficient aeration, the desilvering property of the bleaching solution which was initially good, gradually decreased as the processing proceeds and simultaneously a reduction in the density of the cyan dye occurred.

The present inventors examined this phenomenon extensively, and have unexpectedly found that desilveration proceeds very well in an insufficiently aerated condition in which the oxidation reduction potential of the bleaching solution is 100 mV or less, and scarcely any reduction in the density of the cyan dye occurs.

Aeration for maintaining the oxidation reduction potential of the bleaching solution within the range specified in this invention can be carried out by various methods.

For example, it is possible to attach an oxidation reduction potentiometer to a bleaching bath of an automatic processor and interlock it with an aeration pump, thereby controlling aeration. There can also be employed a method in which, aeration pump is connected to a film detecting device provided in the film insertion part of an automatic film processor and aeration is performed temporarily while film is passing through the insertion part. In any case, any type of aeration is feasible which maintains the oxidation reduction potential of the bleaching solution within the above-specified range. In some cases, it is sufficient to circulate the bleaching solution within the bath without aeration.

Preferred examples of the compound of general formula (I) or (II) are shown below.

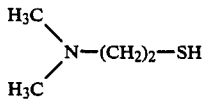
(I)-(1)

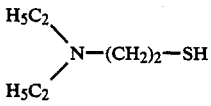
(I)-(2)

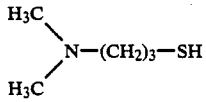
(I)-(3)

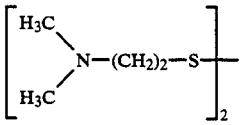
(II)-(1)

-continued

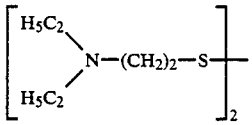
(II)-(2)

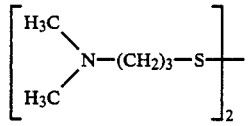
(II)-(3)

The bleach accelerator used in this invention may be added as a solid or an aqueous solution to the bleaching solution. As required, it may be dissolved in an organic solvent. The use of organic solvent does not adversely affect its accelerating effect.

The amount of the bleach accelerator to be included into the bleaching solution varies depending upon the composition of the bleaching solution, the type of a color photographic material to be processed, the processed temperature, the time required for the intended processing, etc. Its suitable amount is $1\times10^{-4}$ to $1\times10^{-1}$ mole, preferably $1\times10^{-3}$ to $1\times10^{-2}$ mole, per liter of the bleaching solution.

A ferric salt of an aminopolycarboxylic acid is used as a bleaching agent in the bleaching solution used in this invention. It is a complex between a ferric ion and an aminopolycarboxylic acid or its salt.

Typical examples of the aminopolycarboxylic acid or its salt are shown below.

A-1: Ethylenediaminetetraacetic acid
A-2: Disodium ethylenediaminetetraacetate
A-3: Diammonium ethylenediaminetetraacetate
A-4: Tetra(trimethylammonium)ethylenediaminetetraacetate
A-5: Tetrapotassium ethylenediaminetetraacetate
A-6: Tetrasodium ethylenediaminetetraacetate
A-7: Trisodium ethylenediaminetetraacetate
A-8: Diethylenetriaminepentaacetic acid
A-9: Pentasodium diethylenetriaminepentaacetate
A-10: Ethylenediamine-N-(β-hydroxyethyl)-N,N',N'-triacetic acid
A-11: Trisodium ethylenediamine-N-(β-hydroxyethyl)-N,N',N'-triacetate
A-12: Triammonium ethylenediamine-N-(β-hydroxyethyl)-N,N',-N'-triacetate
A-13: Propylenediaminetetraacetic acid
A-14: Disodium propylenediaminetetraacetate
A-15: Nitrilotriacetic acid
A-16: Trisodium nitrilotriacetate
A-17: Cyclohexanediaminetetraacetic acid
A-18: Disodium cyclohexanediaminetetraacetate
A-19: Iminodiacetic acid
A-20: Dihydroxyethylglycine
A-21: Ethylether diaminetetraacetic acid
A-22: Glycolether diaminetetraacetic acid
A-23: Ethylenediaminetetrapropionic acid.

The invention, of course, is not limited to these illustrated compounds.

Of these, compounds A-1 to A-4 and A-17 to A-19 are preferred.

The ferric salt of aminopolycarboxylic acid may be used as such. Alternatively, a ferric salt of an aminopolycarboxylic acid may be formed in solution by using a ferric salt such as ferric sulfate, ferric chloride, ferric nitrate, ammonium ferric sulfate and ferric phosphate and the aminopolycarboxylic acid. When the ferric salt of aminopolycarboxylic acid is used from the start, one kind, or two or more kinds of ferric salts f aminopolycarboxylic acid may be used. On the other hand, when the ferric salt of aminopolycarboxylic acid is to be formed in solution from the ferric salt and the aminopolycarboxylic acid, at least one kind of the ferric salt and at least one kind of the aminopolycarboxylic acid may be used. In either case, the aminopolycarboxylic acid may be used in an amount in excess of that required for the formation of the ferric complex.

The bleaching solution or bleach-fixing solution containing the ferric salt of aminopolycarboxylic acid may also contain a salt of another metallic ion such as cobalt and copper.

In addition to the bleaching agent and the aforesaid compounds, the bleaching solution in accordance with this invention may contain a re-halogenating agent, for example, bromides such as potassium bromide, sodium bromide and ammonium bromide and chlorides such as potassium chloride, sodium chloride or ammonium chloride in a concentration of 0.2 to 4 moles/l, preferably 0.5 to 2.5 moles/l. It is also possible to add at least one inorganic or organic acid or salt thereof having pH buffering activity such as boric acid, borax, sodium metaborate, acetic acid, sodium acetate, sodium carbonate, potassium carbonate, phosphorous acid, phosphoric acid, sodium phosphate, citric acid, sodium citrate and tartaric acid, and other known additives that can be customarily used in bleaching baths.

The concentration of the bleaching agent in the bleaching solution is 0.1 to 2 moles/l, preferably 0.1 to 1.0 mole/l and the pH of the bleaching solution in use is desirably 3.0 to 8.0, especially 4.0 to 7.0.

In the present invention, the fixing solution may contain a fixing agent such as thiosulfates (e.g., sodium thiosulfate, ammonium thiosulfate, ammonium sodium thiosulfate or potassium thiosulfate), and thiocyanates (e.g., sodium thiocyanate, ammonium thiocyanate or potassium thiocyanate). The concentration of the fixing agent is preferably 0.1 to 10 moles/l.

Known aromatic primary amine-type color developing agents widely used in various color photographic processes may be used in the color developer in this invention. These developing agents include aminophenol derivatives and p-phenylenediamine derivatives. Generally, these compounds are used in the form of salts, such as hydrochlorides or sulfates, because the salts are more stable than the free compounds. The concentration of such a compound is generally about 0.1 to about 30 g, preferably about 1 to about 15 g, per liter of the color developer.

The aminophenol developers include, for example, o-aminophenol, p-aminophenol, 5-amino-2-hydroxytoluene, 2-amino-3-hydroxytoluene and 2-hydroxy-3-amino-1,4-dimethylbenzene.

The especially useful aromatic primary amino-type color developers are N,N-dialkyl-p-phenylenediamine-type compounds in which the alkyl groups and the phenyl group may be substituted or unsubstituted. Especially preferred compounds among these are N,n-diethyl-p-phenylenediamine hydrochloride, N-methyl-p-phenylenediamine hydrochloride, N,N-dimethyl-p-phenylenediamine hydrochloride, 2-amino-5-(N-ethyl-N-dodecylamino)toluene, N-ethyl-N-β-methanesulfonamidoethyl-3-methyl-4-aminoaniline sulfate, N-ethyl-N-β-hydroxyethylaminoaniline, 4-amino-3-methyl-N,N-diethylaniline, and 4-amino-N-(2-hydroxyethyl)-N-ethyl-3-methylaniline-p-toluenesulfonate.

As required, the alkaline color developer used in this invention may further contain, in addition to the aromatic primary amine-type color developer, various components normally added to color developers, for example alkaline agents such as sodium hydroxide, sodium carbonate and potassium carbonate, alkali metal sulfites, alkali metal bisulfites, alkali metal thiocyanates, alkali metal halides, benzyl alcohol, water softening agents and thickeners. The pH of the color developer is usually at least 7, and most generally about 9 to about 13.

The method of this invention may also be used in color reversal processing. In the present invention, a developer called a black-and-white first developer used in reversal processing of color photographic materials and a black-and-white developer used in processing black-and-white photographic materials, which are usually known, may be used as the black-and-white develoer solution. Various well known additives generally added to black-and-white developers may be included.

Typical additives include, for example, developing agents such as 1-phenyl-3-pyrazolidone, Metol (i.e., p-methylaminophenol) and hydroquinone, preservatives such as sulfites, accelerators such as sodium hydroxide, sodium carbonate, and potassium carbonate, inorganic or organic inhibitors such as potassium bromide, 2-methylbenzimidazole or methylbenzothiazole, hard water softening agents such as polyphosphoric acid salts, a trace amount of iodides, and development inhibitors such as mercapto compounds.

The processing method in accordance with this invention comprises color development, bleaching, fixing, etc. Generally, after the fixing step, water washing and stabilizing steps are carried out. A simple method of processing may be used which involves stabilizing step without substantial water washing after the fixing step.

The color photographic material to be processed in the presence of the particular compound in accordance with this invention is a known color photographic material. The method of this invention can be particularly advantageously used in processing a multilayer negative color photographic material containing a coupler or a color photographic material made for reversal color processing. The method of this invention can also process color X-ray photographic materials, monolayer specil color photographic materials, and color photographic materials containing therein black-and-white developing agents such as the 3-pyrazolidones described in U.S. Pat. Nos. 2,751,297 and 3,902,905, and Japanese Patent Application (OPI) Nos. 64339/81, 85748/81 and 85749/81, and the precursors of color development agents described in U.S. Pat. Nos. 2,478,400, 3,342,597, 3,342,599, 3,719,492 and 4,214,047, and Japanese Patent Application (OPI) No. 135628/78.

The color photographic material may safely be processed even when a coupler is included in the developer.

The following non-limiting Examples illustrate the present invention more specifically.

EXAMPLE 1

On a triacetyl cellulose film were applied the following layers to prepare a multilayer color photographic material.

1st layer: An antihalation layer

A gelatin layer containing black colloidal silver

2nd layer: An interlayer

A gelatin layer containing an emulsion dispersion of 2,5-di-t-octylhydroquinone.

3rd layer: A low-speed red sensitive emulsion layer

Silver iodobromide emulsion (5 mol% silver iodide); amount of silver coated 1.6 g/m$^2$ Sensitizing dye I; $6\times10^{-5}$ mole per mole of silver Sensitizing dye II; $1.5\times10^{-5}$ mole per mole of silver Coupler EX-1; 0.04 mole per mole of silver Coupler EX-5; 0.003 mole per mole of silver Coupler EX-6; 0.0006 mole per mole of silver 4th layer: A high-speed red sensitive emulsion layer Silver iodobromide emulsion (10 mol% silver iodide); amount of silver coated 1.4 g/m$^2$ Sensitizing dye I; $3\times10^{-5}$ mole per mole of silver Sensitizing dye II; $1.2\times10^{-5}$ mole per mole of silver Coupler EX-2; 0.02 mole per mole of silver Coupler EX-5; 0.0016 mole per mole of silver 5th layer: An interlayer The same as the second layer.

6th layer: A low-speed green-sensitive emulsion layer

Monodisperse silver iodobromide emulsion (4 mol% of silver iodide); amount of silver coated 1.2 g/m$^2$ Sensitizing dye III; $3\times10^{-5}$ mole per mole of silver Sensitizing dye IV; $1\times10^{-5}$ mole per mole of silver Coupler EX-4; 0.05 mole per mole of silver Coupler EX-7; 0.008 mole per mole of silver Coupler EX-6; 0.0015 mole per mole of silver 7th layer: A high-speed green sensitive emulsion layer Silver iodobromide emulsion (10 mol% of silver iodide); amount of silver coated 1.3 g/m$^2$ Sensitizing dye III; $2.5\times10^{-5}$ mole per mole of silver Sensitizing dye IV; $0.8\times10^{-5}$ mole per mole of silver Coupler EX-3; 0.017 mole per mole of silver Coupler EX-7; 0.003 mole per mole of silver Coupler EX-9; 0.003 mole per mole of silver 8th layer: A yellow filter layer A gelatin layer containing yellow colloidal silver and an emulsion dispersion of 2,5-di-t-octylhydroquinone in an aqueous solution of gelatin.

9th layer: A low-speed blue sensitive emulsion layer

Silver iodobromide emulsion (6 mol% of silver iodide); amount of silver coated 0.7 g/m$^2$ Coupler EX-8; 0.25 mole per mole of silver Coupler EX-6; 0.015 mole per mole of silver 10th layer: A high-speed blue sensitive emulsion layer Silver iodobromide emulsion (6 mol% of silver iodide); amount of silver coated 0.6 g/m$^2$ Coupler EX-8; 0.06 mole per mole of silver 11th layer: A first protective layer Silver iodobromide emulsion (1 mol% of silver iodide, average grain size: 0.07)); amount of silver coated 0.5 g/m$^2$ A gelatin layer containing an emulsion dispersion of an ultraviolet ray-absorbing agent UV-1.

12th layer:

A gelatin layer containing trimethyl methacrylate particles (diameter: about 1.5μ).

Gelatin hardener, H-1, and a surfactant were also added to each of the above layer in addition to the above-described formulations.

The compounds used in preparing the above photographic material were as follows:

Sensitizing dye I: Anhydro-5,5'-dichloro-3,3'-di-(γ-sulfopropyl)-9-ethyl-thiacarbocyanine hydroxide pyridinium salt Sensitizing dye II: Anhydro-9-ethyl-3,3'-di-(γ-sulfopropyl)-4,5,4',5'-dibenzothiacarbocyanine hydroxide triethylamine salt Sensitizing dye III: Anhydro-9-ethyl-5,5'-dichloro-3,3'-di-(γ-sulfopropyl)oxacarbocyanine sodium salt Sensitizing dye IV: Anhydro-5,6,5',6'-tetrachloro-1,1'-diethyl-3,3'-di-{β-[β-(γ-sulfopropyl)ethoxy]ethyl-}imidazolocarbocyanine hydroxide sodium salt.

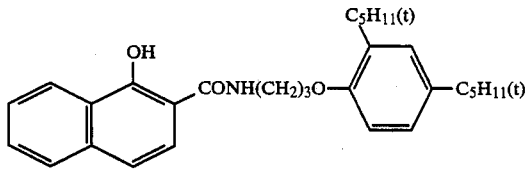

Coupler EX-1

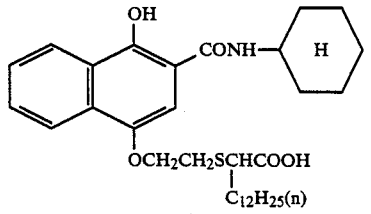

Coupler EX-2

-continued
Coupler EX-3
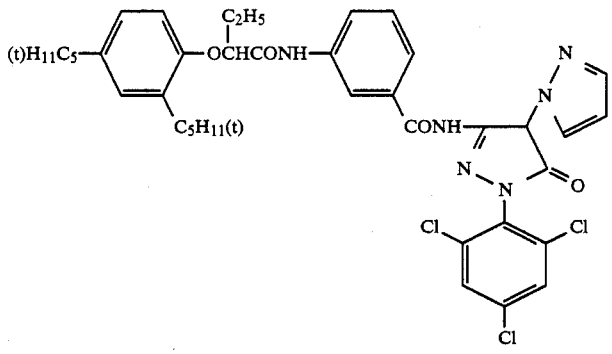
Coupler EX-4
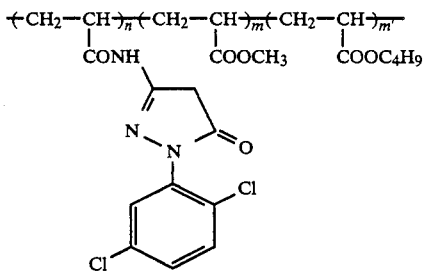
(n/m + m' = 1 m/m' = 1 (weight ratio)
molecular weight: about 40,000)
Coupler EX-5
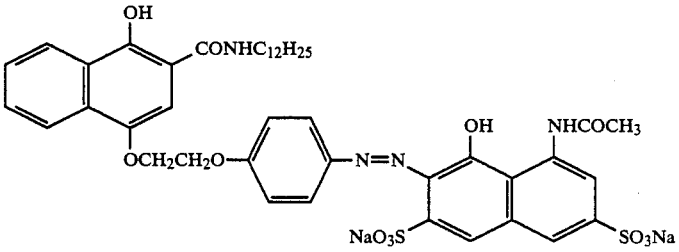
Coupler EX-6
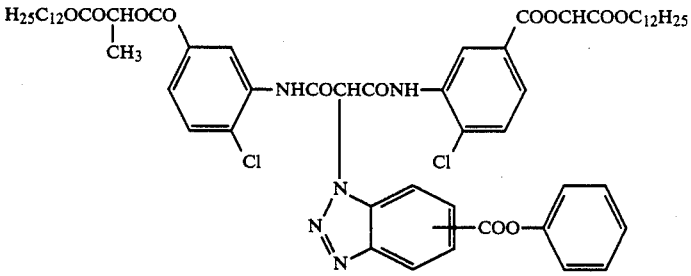
Coupler EX-7
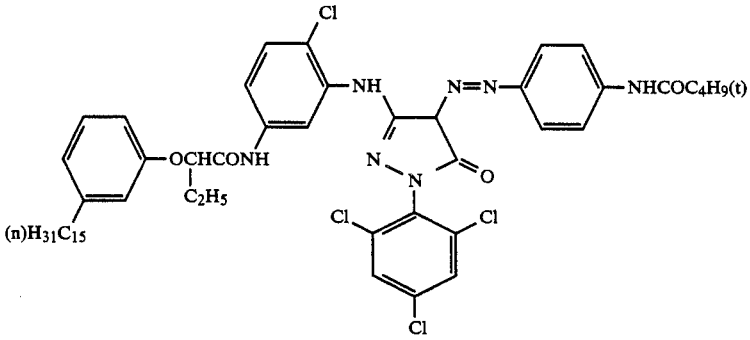

-continued

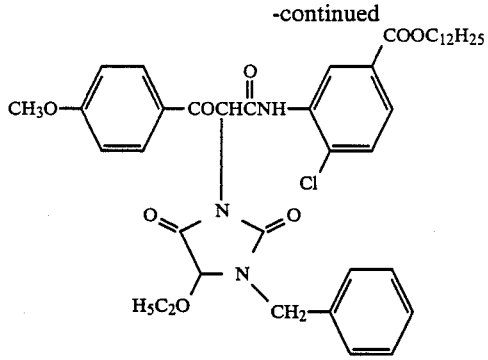

Coupler EX-8

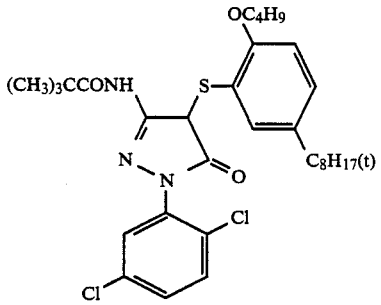

Coupler EX-9

$CH_2{=}CH{-}SO_2{-}CH_2{-}CONH{-}CH_2{-}CH_2{-}NHCO{-}CH_2{-}SO_2{-}CH{=}CH_2$ H-1

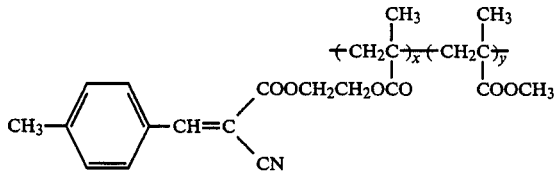

x/y = 7/3 (weight ratio)

UV-1

The resulting color negative film was slit to a width of 35 mm, exposed, and then processed by a cine strip film-type automatic developing processor in accordance with the following developing steps.

| Processing Step | Temperature (°C.) | Time (minutes) |
|---|---|---|
| Color development | 38 | 3 |
| Bleaching | 38 | 1.5 |
| Fixing | 38 | 3 |
| Washing with water | 38 | 3 |
| Stabilization | 38 | 1 |

The bleach accelerator in accordance with this invention was included into both the bleaching solution and the replenisher for bleaching solution. In the bleaching solution tank, aeration was performed so that the bleaching solution attained various oxidation reduction potentials during the processing.

In the cine strip film-type automatic developing processor, the tank capacity was 20 liters for color development and fixation, and 10 liters for bleaching and stabilization.

The amount of the development in the above processing was adjusted to 50 meters of the 35 mm film per day, and each of the processing solutions was replenished at a rate of 40 ml per meter of film treated. At the start of the processing, and at the end of every day, a film strip subjected to stepwise exposure was processed, and with regard to the processed strip, the amount of remaining silver and the density of the cyan dye in a part having a maximum density were measured. The amount of remaining silver was measured by a fluorescent X-ray method. The results are shown in Table 1.

| | Base solution | Replenisher |
|---|---|---|
| Color developer | | |
| Sodium nitrilotriacetate | 1.0 g | 1.1 g |
| Sodium sulfite | 4.0 g | 4.4 g |
| Sodium carbonate | 30.0 g | 32.0 g |
| Potassium bromide | 1.4 g | 0.7 g |
| Hydroxylamine sulfate | 2.4 g | 2.6 g |
| 4-(N—ethyl-N—β-hydroxyethylamino)-2-methylaniline sulfate | 4.5 g | 5.0 g |
| Water to make | 1 liter | 1 liter |
| Bleaching solution | | |
| Ammonium bromide | 160.0 g | 176 g |
| Aqueous ammonia (28%) | 25.0 ml | 15 ml |
| Ferric sodium ethylenediaminetetraaceate | 130.0 g | 143 g |
| Glacial acetic acid | 14.0 ml | 14.0 ml |
| Bleach accelerator (described in Table 1) | $5 \times 10^{-3}$ mole | $7.5 \times 10^{-3}$ mole |
| Water to make | 1 liter | 1 liter |
| Fixing solution | | |
| Sodium tetrapolyphosphate | 2.0 g | 2.2 g |
| Sodium sulfite | 4.0 g | 4.4 g |
| Ammonium thiosulfate (70%) | 175.0 ml | 193.0 ml |
| Sodium bisulfite | 4.6 g | 5.1 g |
| Water to make | 1 liter | 1 liter |
| Stabilizing solution | | |
| Formalin | 8.0 ml | 9.0 ml |

-continued

| | Base solution | Replenisher |
|---|---|---|
| Water to make | 1 liter | 1 liter |

TABLE 1

| Test No. | | Bleach Accelerator | Oxidation reduction potential of the bleaching solution at the start (mV) | Oxidation reduction potential of the bleaching solution during running (mV) | At the Start A | At the Start B | 2 Days Later A | 2 Days Later B | 3 Days Later A | 3 Days Later B | 7 Days Later A | 7 Days Later B | 14 Days Later A | 14 Days Later B |
|---|---|---|---|---|---|---|---|---|---|---|---|---|---|---|
| 1 | Comparison | none | 160 | 120–150 | 8.7 | * | 9.2 | * | | | | | | |
| 2 | " | (I)-(1) | 130 | 120–150 | 1.8 | 1.65 | 3.0 | 1.58 | 4.2 | 1.55 | 8.9 | * | | |
| 3 | This Invention | (I)-(1) | 125 | 80–100 | 2.8 | 1.65 | 3.5 | 1.64 | 3.8 | 1.64 | 3.8 | 1.63 | | |
| 4 | This Invention | (I)-(1) | 130 | 20–80 | 2.1 | 1.64 | 1.9 | 1.64 | 2.0 | 1.65 | 2.4 | 1.63 | 2.3 | 1.64 |
| 5 | Comparison | (II)-(1) | 160 | 110–140 | 1.7 | 1.67 | 3.2 | 1.62 | 5.0 | 1.57 | 9.4 | * | | |
| 6 | This Invention | (II)-(1) | 160 | 80–100 | 1.9 | 1.65 | 2.3 | 1.62 | 2.5 | 1.63 | 2.9 | 1.62 | | |
| 7 | This Invention | (II)-(1) | 155 | 20–80 | 2.0 | 1.64 | 2.3 | 1.62 | 2.7 | 1.61 | 2.5 | 1.63 | 2.6 | 1.63 |
| 8 | Comparison | (II)-(2) | 150 | 110–160 | 2.4 | 1.63 | 3.3 | 1.60 | 4.5 | 1.54 | 9.0 | * | | |
| 9 | This Invention | (II)-(2) | 155 | 20–80 | 2.3 | 1.64 | 2.8 | 1.62 | 2.8 | 1.62 | 3.0 | 1.63 | | |
| 10 | This Invention | (II)-(2) | 150 | 0–20 | 2.2 | 1.61 | 2.6 | 1.60 | 2.7 | 1.61 | 2.9 | 1.60 | | |

The figures in columns A indicate the amount of remaining silver ($\mu g/cm^2$), and the figures in columns B, the optical density of the cyan dye. The asterisks show that the density of the cyan dye could not be measured due to the insufficient desilveration.

As shown in Table 1, when the oxidation reduction potential of the bleaching solution is more than 100 mV, the processing causes incomplete desilveration and decreases the density of the cyan dye despite the use of the bleach accelerator. In contrast, according to the method of this invention, there was no incomplete desilveration nor a decrease in the density of the cyan dye.

EXAMPLE 2

On a triacetylcellulose support having an undercoat layer formed thereon, were coated emulsion layers and auxiliary layers in the following sequence to form a sample.

1st layer: A low-speed red sensitive emulsion layer 100 g of 2-(heptafluorobutylamido)-5-[2'-(2'',4''-di-t-amylphenoxy)butylamido]-phenol as a cyan coupler was dissolved in 100 ml of tricresyl phosphate and 100 ml of ethyl acetate, and the solution was stirred at high speed together with 1 kg of a 10% aqueous solution of gelatin. 500 g of the resulting emulsion was mixed with 1 kg of low-speed red sensitive silver iodobromide emulsion (containing 70 g of silver, 60 g of gelatin and 3 mole% of iodide). The mixture was coated to a dry thickness of 2μ (amount of silver coated: 0.5 $g/m^2$)

2nd layer: A high-speed red sensitive emulsion layer 100 g of 2-(heptafluorobutylamido)-5-[2'-(2'',4''-di-t-amylphenoxy)butylamido]phenol was dissolved in 100 ml of tricresyl phosphate and 100 ml of ethyl acetate. The solution was stirred at high speed together with 1 kg of a 10% aqueous solution of gelatin. 1000 g of the resulting emulsion was mixed with 1 kg of a high-speed red sensitive silver iodobromide emulsion (containing 70 g of silver, 60 g of gelatin and 3 mole% of iodide). The mixture was coated to a dry thickness of 2μ (amount of silver coated: 0.8 $g/m^2$).

3rd layer: An interlayer 2,5-Di-t-octylhydroquinone was dissolved in 100 ml of dibutyl phthalate and 100 ml of ethyl acetate. The solution was stirred at high speed together with 1 kg of a 10% aqueous solution of gelatin. 1 kg of the resulting emulsion was mixed with 1 kg of 10% aqueous solution of gelatin. The mixture was coated to a dry thickness of 1μ.

4th layer: A low-speed green sensitive emulsion layer 500 g of an emulsion obtained in the same manner as in the preparation of the emulsion for the first layer except that 1-(2,4,6-trichlorophenyl)-3-[3-(2,4-di-t-amylphenoxyacetamido)benzamido]-5-pyrazolone as a magenta coupler was used instead of the cyan coupler was mixed with 1 kg of a low-speed green sensitive silver iodobromide emulsion (containing 70 g of silver, 60 g of gelatin and 2.5 mole% of iodine). The mixture was coated to a dry thickness of 2.0μ (amount of silver coated: 0.7 $g/m^2$).

5th layer: A high-speed green sensitive emulsion layer 1000 g of an emulsion obtained in the same manner as in the preparation of the emulsion for the first layer except that 1-(2,4,6-trichlorophenyl)-3-[3-(2,4-di-t-amylphenoxyacetamido)benzamido]-5-pyrazolone as a magenta coupler was used instead of the cyan coupler was mixed with 1 kg of a high-speed green sensitive silver iodobromide (containing 70 g of silver, 60 g of gelatin and 2.5 mole% of iodine). The mixture was coated to a dry thickness of 2.0μ (amount of silver coated: 0.7 $g/m^2$).

6th layer: An interlayer 1 kg of the emulsion used in the third layer was mixed with 1 kg of 10% gelatin, and the mixture was coated to a dry thickness of 1μ.

7th layer: A yellow filter layer

An emulsion containing yellow colloidal silver was coated to a dry thickness of 1μ.

8th layer: A low-speed blue sensitive emulsion layer 1000 g of an emulsion obtained in the same manner as in the preparation of the emulsion for the first layer except that α-(pivaloyl)-α-(1-benzyl-5-ethoxy-3-hydantoinyl)-2-chloro-5-dodecyloxycarbonyl acetanilide as a yellow coupler was used instead of the cyan coupler was mixed with 1 kg of a low-speed blue sensitive silver iodobromide (containing 70 g of silver, 60 g of gelatin and 2.5 mole% of iodine). The mixture was coated to a dry thickness of 2.0μ (amount of silver coated: 0.6 g/m²).

9th layer: A high-speed blue sensitive emulsion layer 1000 g of an emulsion obtained in the same manner as in the preparation of the emulsion for the first layer except that α-(pivaloyl)-α-(1-benzyl-5-ethoxy-3-hydantoinyl)-2-chloro-5-dodecyloxycarbonyl acetanilide as a yellow coupler was used instead of the cyan coupler was mixed with 1 kg of a high-speed blue sensitive silver iodobromide (containing 70 g of silver, 60 g of gelatin and 2.5 mole% of iodine). The mixture was coated to a dry thickness of 2.0μ (amount of silver coated: 1.0 g/m²).

10th layer: A second protective layer 1 kg of the emulsion used in the third layer was mixed with 1 kg of 10% aqueous solution of gelatin, and the mixture was coated to a dry thickness of 2μ.

11th layer: A first protective layer

A 10% aqueous solution of gelatin containing a fine grain emulsion (particle size: 0.15μ, 1 mole% silver iodobromide emulsion) not chemically sensitized was coated to a dry thickness of 1μ so that the amount of silver coated was 0.3 g/m².

The resulting color reversal film was slit to, a width of 35 mm, imagewise exposed, and developed by a cine strip film-type automatic developing processor in accordance with the following development process.

| Processing Step | Temperature (°C.) | Time (minutes) |
|---|---|---|
| First development | 38 | 6 |
| Washing with water | " | 2 |
| Reversal | " | 2 |
| Color development | " | 6 |
| Conditioning | " | 2 |
| Bleaching | " | 2.5 |
| Fixing | " | 4 |
| Washing with water | " | 4 |
| Stabilization | room temperature | 1 |

The bleach accelerator in accordance with this invention was included into both the bleaching solution and the replenisher for bleaching solution. In the bleaching solution tank, aeration was carried out in the same manner as in Example 1. In the cine strip film-type automatic developing processor, the tank capacity was 20 liters for the first development, color development and fixing, and 10 liters for the rest.

The amount of processing by the above steps was adjusted to 50 meters of the 35 mm film per day. The first developer and the color developer were replenished with replenishers of the following compositions at a rate of 80 ml per meter of the film with a width of 35 mm. To the other processing solutions, replenishers of the following composition were added at a rate of 40 ml per meter of the film having a width of 35 mm.

| | Base solution | Replenisher |
|---|---|---|
| First developer | | |
| Water | 700 ml | 700 ml |
| Sodium tetrapolyphosphate | 2 g | 2 g |
| Sodium sulfite | 20 g | 22 g |
| Hydroquinone.monosulfonate | 30 g | 32 g |
| Sodium carbonate(monohydrate) | 30 g | 30 g |
| 1-Phenyl-4-methyl-4-hydroxy-methyl-3-pyrazolidone | 2 g | 2 g |
| Potassium bromide | 2.5 g | 0 g |
| Potassium thiocyanate | 1.2 g | 1.2 g |
| Potassium iodide (0.1% solution) | 2 ml | 0 ml |
| Water to make | 1 liter | 1 liter |
| Reversing bath | | |
| Water | 700 ml | 700 ml |
| Hexasodium.nitrilo-N,N,N—trimethylenephosphonate | 3 g | 3 g |
| Stannous chloride (dihydrate) | 1 g | 1 g |
| p-Aminophenol | 0.1 g | 1 g |
| Sodium hydroxide | 8 g | 8 g |
| Glacial acetic acid | 15 ml | 15 ml |
| Water to make | 1 liter | 1 liter |
| Color development bath | | |
| Water | 700 ml | 700 ml |
| Sodium tetrapolyphosphate | 2 g | 2 g |
| Sodium sulfite | 7 g | 8 g |
| Sodium tertiary phosphate (dodecahydrate) | 36 g | 36 g |
| Potassium bromide | 1 g | 0.3 g |
| Potassium iodide (0.1% solution) | 90 ml | 0 ml |
| Sodium hydroxide | 3 g | 3 g |
| Citrazinic acid | 1.5 g | 1.5 g |
| N—ethyl-N—(β-methanesulfonamido-ethyl)-3-methyl-4-amino-aniline.sulfate | 11 g | 12 g |
| Ethylenediamine | 3 g | 3 g |
| Water to make | 1 liter | 1 liter |
| Conditioning bath | | |
| Water | 700 ml | 700 ml |
| Sodium bisulfite | 12 g | 12 g |
| Sodium ethylenediaminetetra-acetate (dihydrate) | 8 g | 8 g |
| Glacial acetic acid | 3 ml | 3 ml |
| Water to make | 1 liter | 1 liter |
| Bleaching bath | | |
| Water | 800 ml | 800 ml |
| Sodium ethylenediaminetetra-acetate (dihydrate) | 2.0 g | 2.0 g |
| Ammonium iron (III) ethylene-diaminetetraacetate (dihydrate) | 120.0 g | 180.0 g |
| Potassium bromide | 100.0 g | 150.0 g |
| Bleach promoting agent (described in Table 2) | $5 \times 10^{-3}$ mole | $1.0 \times 10^{-2}$ mole |
| Water to make | 1 liter | 1 liter |
| Fixing bath | | |
| Water | 800 ml | 800 ml |
| Ammonium thiosulfate | 80.0 g | 80.0 g |
| Sodium sulfite | 5.0 g | 5.0 g |
| Sodium bisulfite | 5.0 g | 5.0 g |
| Water to make | 1.0 liter | 1.0 liter |
| Stabilizing bath | | |
| Water | 800 ml | 800 ml |
| Formalin (37% by weight) | 5.0 ml | 5.0 ml |
| Fuji DriWel (Product of Fuji Photo Film Co., Ltd.) | 5.0 ml | 5.0 ml |
| Water to make | 1 liter | 1 liter |

At the start of the development, and at the end of the processing every day, a film strip subjected to stepwise exposure was processed, and with regard to the processed strips, the amount of remaining silver and the density of the cyan dye in a part having a maximum density were measured.

The amount of remaining silver was measured by a fluorescent X-ray method.

TABLE 2

| Test No. | | Bleach Accelerator | Oxidation reduction potential of the bleaching solution at the start (mV) | Oxidation reduction potential of the bleaching solution during running (mV) | At the Start A | At the Start B | 2 Days Later A | 2 Days Later B | 3 Days Later A | 3 Days Later B | 7 Days Later A | 7 Days Later B | 14 Days Later A | 14 Days Later B |
|---|---|---|---|---|---|---|---|---|---|---|---|---|---|---|
| 1 | Comparison | none | 150 | 110–160 | 11.7 | * | 13.2 | * | | | | | | |
| 2 | " | (I)-(2) | 135 | 105–150 | 1.6 | 1.92 | 2.9 | 1.91 | 4.9 | 1.89 | 10.0 | * | | |
| 3 | This Invention | (I)-(2) | 135 | 70–100 | 1.8 | 1.92 | 2.0 | 1.92 | 2.8 | 1.94 | 3.0 | 1.94 | | |
| 4 | This Invention | (I)-(2) | 135 | 0–50 | 1.6 | 1.94 | 2.0 | 1.92 | 2.3 | 1.92 | 2.2 | 1.92 | | |
| 5 | Comparison | (II)-(1) | 140 | 110–160 | 1.4 | 1.94 | 1.8 | 1.92 | 4.2 | 1.92 | 10.9 | * | | |
| 6 | This Invention | (II)-(1) | 140 | 80–100 | 1.7 | 1.92 | 1.9 | 1.93 | 2.6 | 1.95 | 2.6 | 1.94 | | |
| 7 | This Invention | (II)-(1) | 140 | 20–80 | 1.6 | 1.94 | 1.9 | 1.94 | 2.0 | 1.95 | 2.1 | 1.94 | 2.1 | 1.94 |
| 8 | Comparison | (II)-(2) | 150 | 120–160 | 2.0 | 1.93 | 3.7 | 1.90 | 4.6 | 1.89 | 9.9 | * | | |
| 9 | This Invention | (II)-(2) | 150 | 60–100 | 1.9 | 1.93 | 2.5 | 1.95 | 3.0 | 1.95 | 3.1 | 1.95 | | |
| 10 | This Invention | (II)-(2) | 150 | 20–80 | 1.7 | 1.94 | 2.0 | 1.94 | 2.2 | 1.93 | 2.2 | 1.93 | | |

The figures in columns A and B and the asterisks are the same as the footnote to Table 1.

The results given in Table 2 demonstrate that very good results can be obtained when the oxidation reduction potential of the bleaching solution was not more than 100 mV as in Example 1.

While the invention has been described in detail and with reference to specific embodiments thereof, it will be apparent to one skilled in the art that various changes and modifications can be made therein without departing from the spirit and scope thereof.

What is claimed is:

1. A method for processing a silver halide color photographic material which comprises subjecting an image-wise exposed silver halide color photographic material to color development and then bleaching the developed color photographic material with a bleaching solution containing a ferric salt of an aminopolycarboxylic acid in a continuous process in an automatic processor, wherein said bleaching solution additionally contains at least one compound represented by the following general formula (I) or (II)

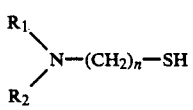

(I)

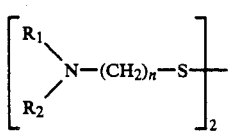

(II)

wherein $R_1$ and $R_2$ are identical or different and each represents a hydrogen atom or a methyl or ethyl group, and n represents an integer of 1 to 3, the oxidation-reduction potential of the bleaching solution initially being 120 mV or greater, the oxidation-reduction potential being initially adjusted from a value above 100 mV to a value within the range of 0 to 100 mV and maintained within the range of 0 mV to 100 mV by controlled aeration of the bleaching solution or the oxidation-reduction potential being maintained by controlled aeration of the bleaching solution within 2 days after the initiation of bleaching such as to remain in the range of 9 mV to 100 mV.

2. The method of claim 1 wherein each of $R_1$ and $R_2$ is a methyl or ethyl group, and n is 2.

3. The method of claim 1 wherein the compound of formula (I) or (II) is selected from the group consisting of

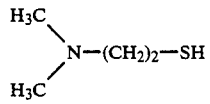

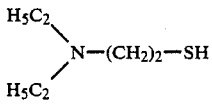

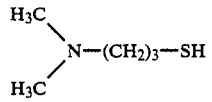

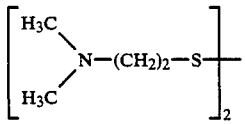

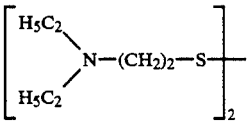

and

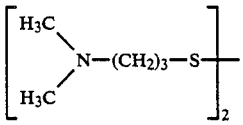

4. The method of claim 1 wherein the amount of the compound of formula (I) or (II) is $1\times10^{-4}$ to $1\times10^{-1}$ mole per liter of the bleaching solution.

5. The method of claim 1 wherein the amount of the compound of formula (I) or (II) is $1\times10^{-3}$ to $1\times10^{-2}$ mole per liter of the bleaching solution.

6. The method of claim 1, wherein the oxidation reduction potential of the bleaching solution is initially adjusted to 20 mV to 80 mV and is maintained within the range of 20 mV to 80 mV by controlled aeration of the bleaching solution or the oxidation-reduction potential of the bleaching solution is maintained in the range of 20 mV to 80 mV by controlled aeration of the bleaching solution within two days after initiation of bleaching such as to remain in the range of 20 mV to 80 mV.

7. The method of claim 1, wherein the oxidation reduction potential of the bleaching solution is adjusted after the initiation of bleaching.

8. The method of claim 7, wherein the oxidation reduction potential of the bleaching solution is adjusted after several hours to two days of using the bleaching solution.

9. The method of claim 8, wherein the aminopolycarboxylic acid is selected from the group consisting of ethylenediaminetetraacetic acid, disodium ethylenediaminetetraacetate, diammonium ethylenediaminetetraacetate, tetra(trimethylammonium) ethylenediaminetetraacetate, cyclohexanediaminetetraacetic acid, disodium cyclohexanediaminetetraacetate, and iminodiacetic acid.

10. The method of claim 7, wherein the concentration of the ferric salt of the aminopolycarboxylic acid in the bleaching solution is 0.1 to 2 mol/l.

11. The method of claim 9, wherein the concentration of the ferric salt of the aminopolycarboxylic acid in the bleaching solution is 0.1 to 1.0 mol/l.

12. The method of claim 10, wherein the color development is with a developing solution containing an aromatic primary amine developing agent and the concentration thereof in the color developer is about 0.01 to about 30 g per liter of the color developer.

13. The method of claim 11, wherein the color development is with a developing solution containing an aromatic primary amine developing agent and the concentration thereof in the color developer is about 1 to about 15 g per liter of the color developer.

14. The method of claim 1, wherein the imagewise exposed silver halide color photographic material is subjected to fixing in a fixing solution following bleaching.

* * * * *